US009084971B1

(12) United States Patent
Villaseñor

(10) Patent No.: US 9,084,971 B1
(45) Date of Patent: Jul. 21, 2015

(54) PAINT AGITATING SYSTEM

(71) Applicant: Jose A. Villaseñor, Tucson, AZ (US)

(72) Inventor: Jose A. Villaseñor, Tucson, AZ (US)

( * ) Notice: Subject to any disclaimer, the term of this patent is extended or adjusted under 35 U.S.C. 154(b) by 23 days.

(21) Appl. No.: 13/973,605

(22) Filed: Aug. 22, 2013

Related U.S. Application Data

(60) Provisional application No. 61/692,094, filed on Aug. 22, 2012.

(51) Int. Cl.

| | |
|---|---|
| ***B05B 7/04*** | (2006.01) |
| ***B05B 7/24*** | (2006.01) |
| ***B01F 7/00*** | (2006.01) |
| ***B05B 15/00*** | (2006.01) |

(52) U.S. Cl.
CPC ..... *B01F 7/00008* (2013.01); *B05B 7/0408* (2013.01); *B05B 7/2408* (2013.01); *B05B 15/003* (2013.01)

(58) Field of Classification Search
CPC ..... B05B 7/04; B05B 7/0408; B05B 7/2408
USPC ..... 239/142, 302, 310, 329, 331, DIG. 14; 366/244, 245, 247, 249, 281, 282, 315, 366/316, 343, 605
See application file for complete search history.

(56) References Cited

U.S. PATENT DOCUMENTS

| | | | | | |
|---|---|---|---|---|---|
| 1,698,402 | A * | 1/1929 | Harris | 366/247 |
| 3,672,645 | A * | 6/1972 | Terrels et al. | 366/250 |
| 4,175,875 | A * | 11/1979 | Van Horbek | 366/343 |
| 4,944,600 | A * | 7/1990 | McKelvey | 366/142 |
| 5,676,463 | A * | 10/1997 | Larsen | 366/251 |
| 6,419,385 | B1 * | 7/2002 | Walls | 366/247 |
| 6,712,499 | B2 * | 3/2004 | Fink, Jr. | 366/325.5 |
| 6,820,824 | B1 * | 11/2004 | Joseph et al. | 239/346 |
| 8,414,180 | B1 * | 4/2013 | Mattingly et al. | 366/247 |

* cited by examiner

*Primary Examiner* — Ryan Reis

(57) ABSTRACT

A paint agitating system features a generally cylindrical mixing cup and a paddle having a plurality of paddle blades connected at paddle inside edges. The paddle blades feature one or more cutouts forming an interior open paddle area. A shaft is located at an intersection of the paddle top edges. A flexible blade is located on the paddle. The system features a rotating means for rotating the paddle via the shaft.

15 Claims, 6 Drawing Sheets

PAINT AGITATING SYSTEM

CROSS REFERENCE

This application claims priority to U.S. Provisional Patent Application No. 61/692,094, filed Aug. 22, 2012, the specification(s) of which is/are incorporated herein in their entirety by reference.

FIELD OF THE INVENTION

The present invention relates to equipment and system used for painting, or more specifically, equipment and systems used to agitate or stir paint.

BACKGROUND OF THE INVENTION

Paint can be defined as a liquid, liquefiable, or mastic composition which, after applying a thin layer to a substrate, leaves a solid film upon drying. It is most commonly used to protect, color, or provide texture to an object. Stir sticks are typically used to mix paint before applying, although other mechanical stirring means may be used such as motorized paint stirrers and pain shakers (paint tumblers). The present invention features a paint agitating system.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a paint agitating system with a generally cylindrical mixing cup. In some embodiments, the system comprises a paddle having a plurality of paddle blades connected at paddle inside edges. In some embodiments, the paddle blades comprise one or more cutouts forming an interior open paddle area. In some embodiments, a shaft is located at an intersection of the paddle top edges. In some embodiments, a flexible blade is located on the paddle, in some embodiments, the system comprises a rotating means for rotating the paddle via the shaft.

In some embodiments, paint is poured into the mixing cup. In some embodiments, the paddle is placed into the mixing cup. In some embodiments, the rotating means is fastened to the shaft. In some embodiments, the paddle is rotated via the rotating means to mix the paint. In some embodiments, paint is scraped off the mixing cup for mixing via the flexible blade. In some embodiments, paint is mixed via the paddle blade.

DESCRIPTION OF PREFERRED EMBODIMENTS

Figure 1:
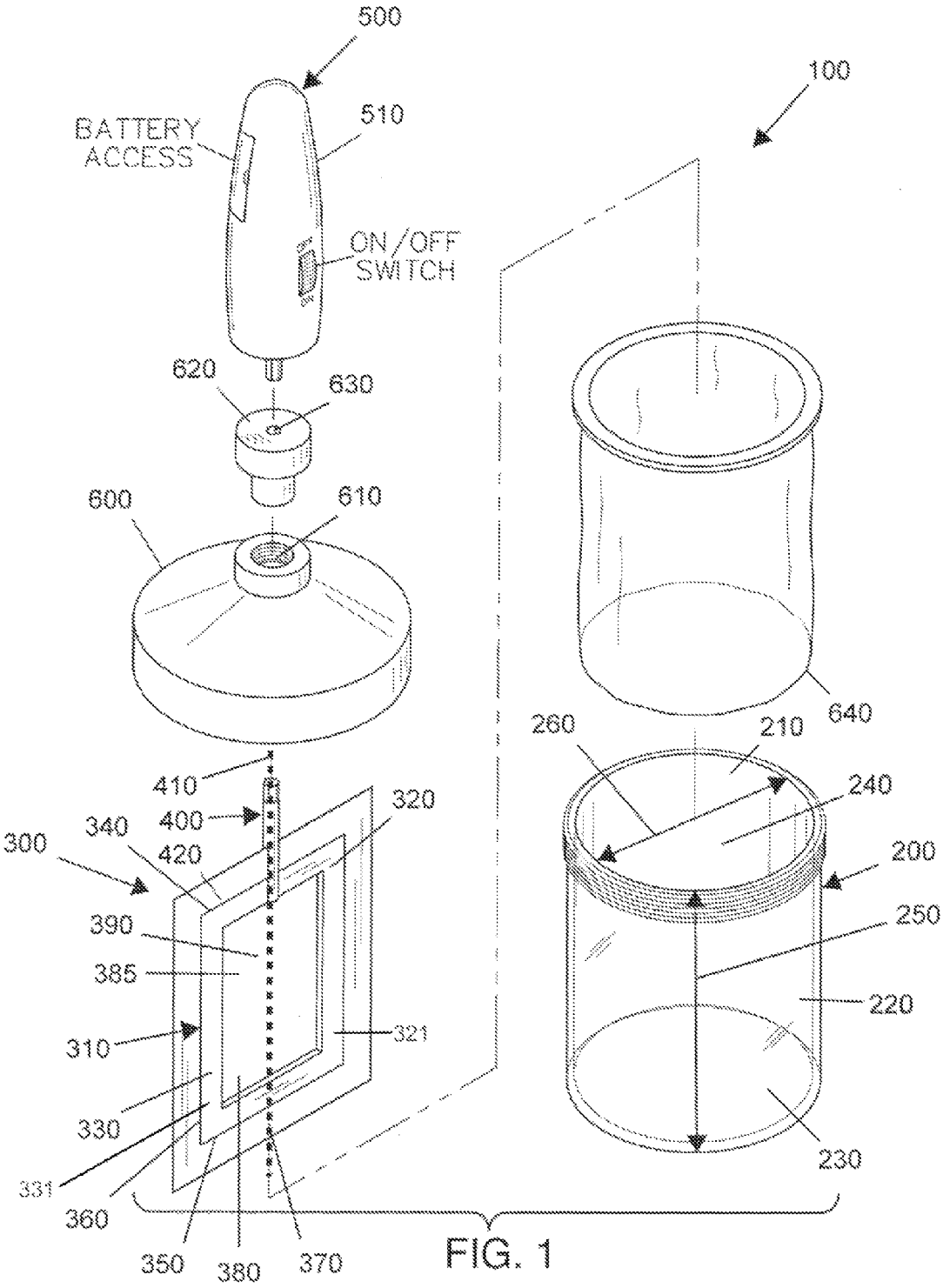
FIG. 1 is a perspective view of the present invention featuring a mixing cup, a paddle, and a rotating means.
Figure 2:
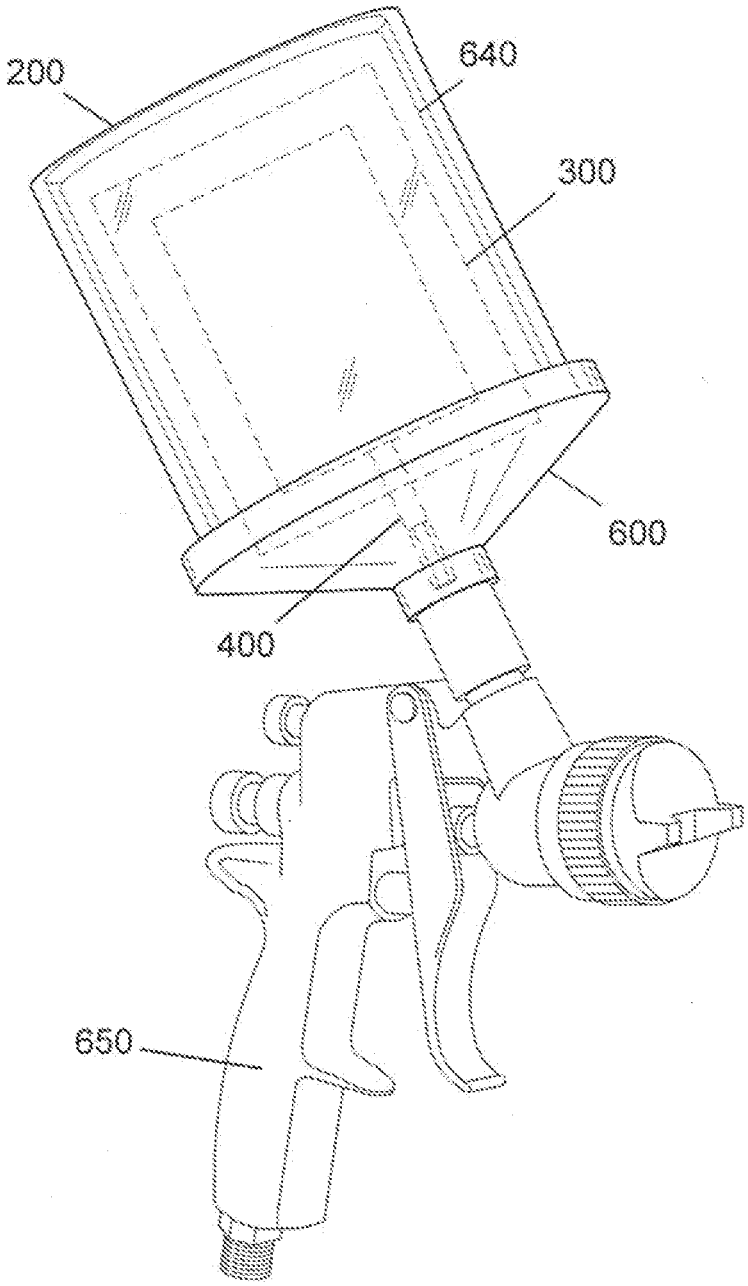
FIG. 2 is a perspective view of an alternate embodiment of the present invention featuring a paint sprayer.
Figure 3:
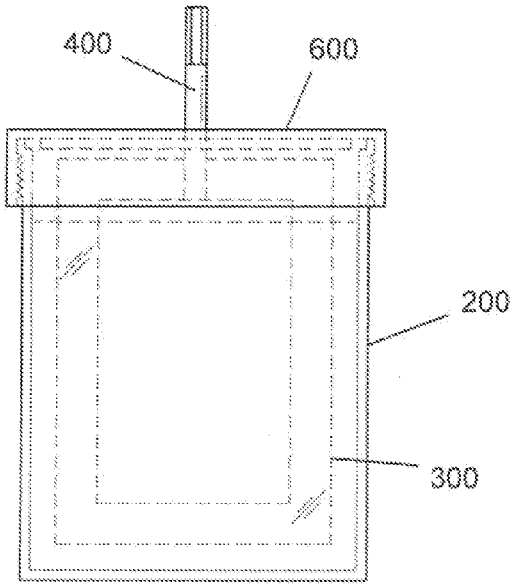
FIG. 3 is a front view of the mixing cup and the paddle of the present invention.
Figure 4:
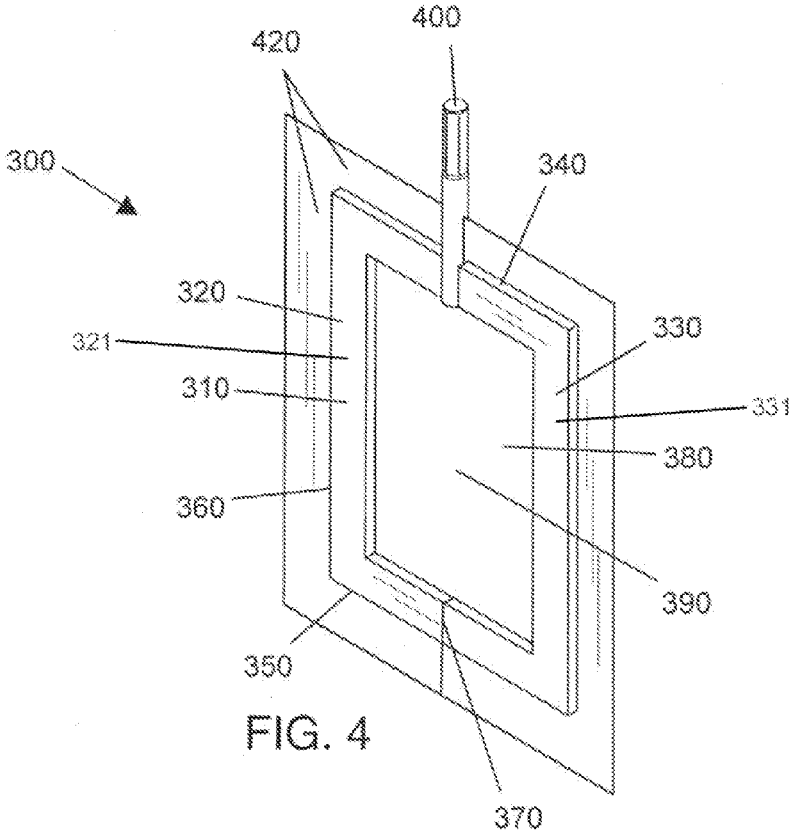
FIG. 4 is a perspective view of the paddle of the present invention.
Figure 5:
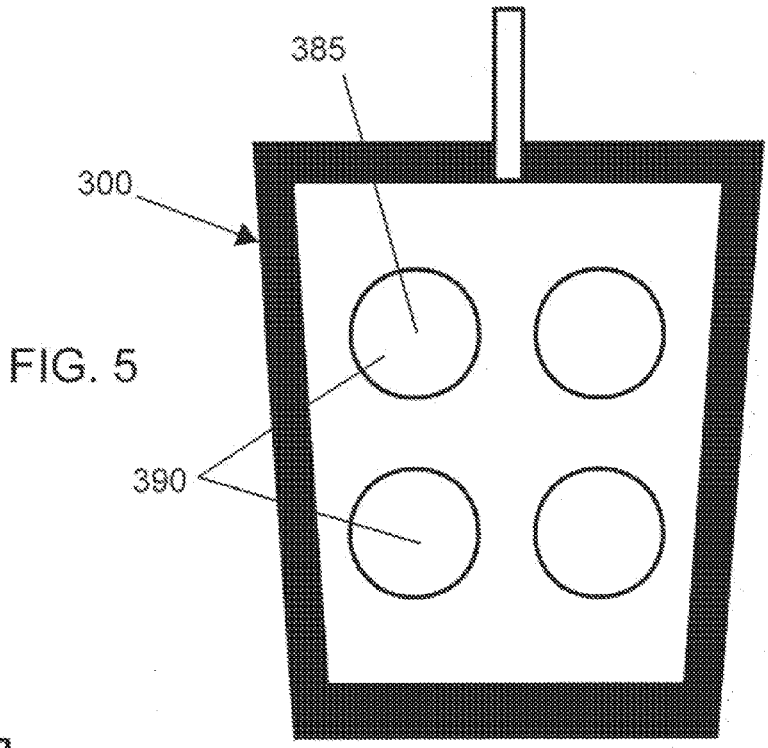
FIG. 5 is a front view of an alternate embodiment of the paddle of the present invention featuring a circular cutout.
Figure 6:
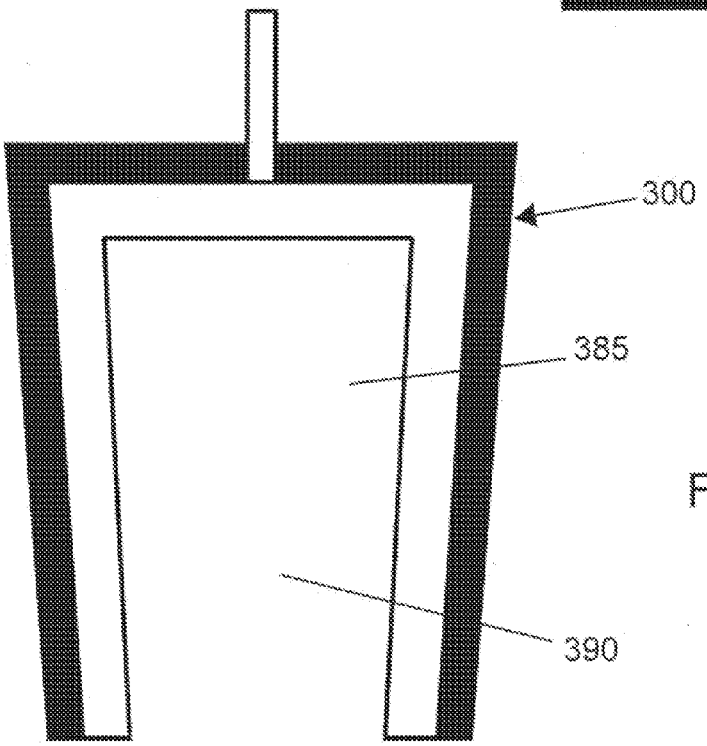
FIG. 6 is a front view of an alternate embodiment of the paddle of the present invention featuring a notched cutout.
Figure 7:
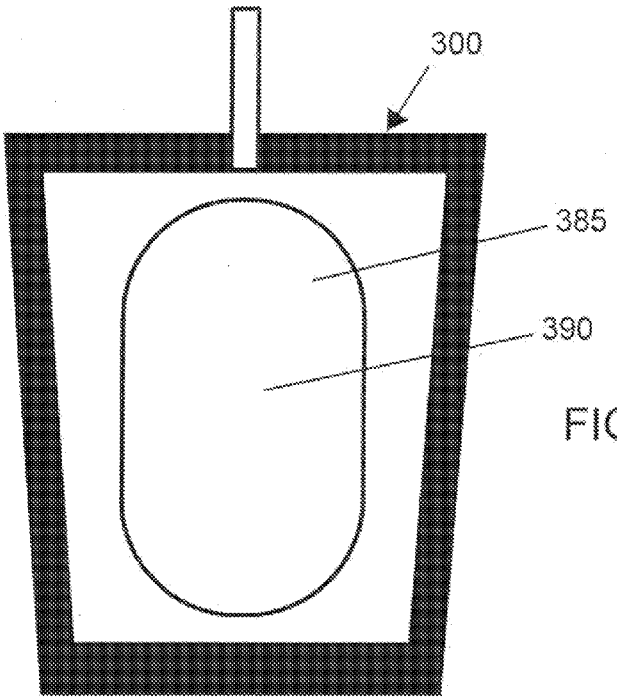
FIG. 7 is a front view of an alternate embodiment of the paddle of the present invention featuring an ovular cutout.
Figure 8:
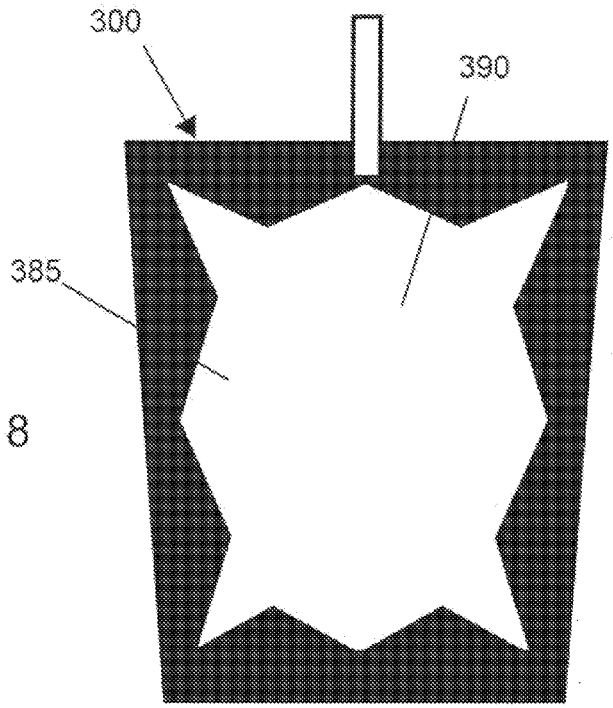
FIG. 8 is a front view of an alternate embodiment of the paddle of the present invention featuring an irregularly shaped cutout.
Figure 9:
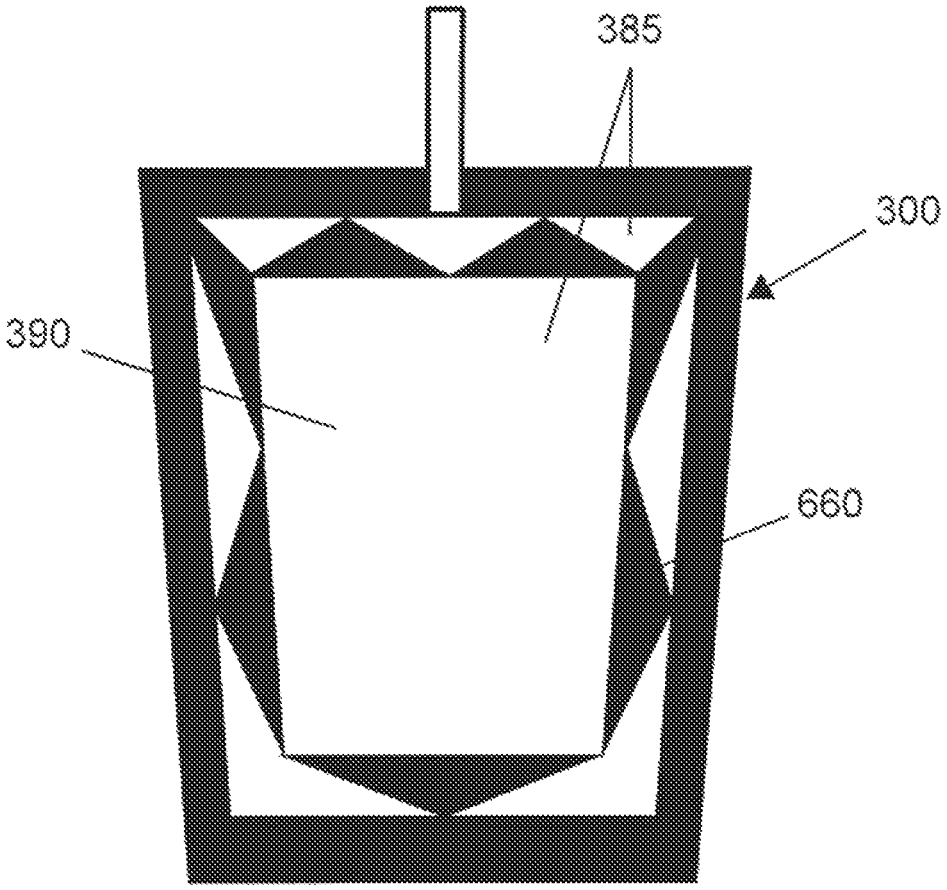
FIG. 9 is a front view of an alternate embodiment of the paddle of the present invention featuring a cutout having secondary paddle blade components.

Following is a list of elements corresponding to a particular element referred to herein:

100 Paint agitating system
200 Mixing cup
210 Open cup top
220 Cup side wall
230 Cup bottom interior surface
240 Cup interior cavity
250 Cup height
260 Cup diameter
300 Paddle
310 Paddle blade
320 Paddle first surface
330 Paddle second surface
340 Paddle top edge
350 Paddle bottom edge
360 Paddle outside edge
370 Paddle inside edge
380 Paddle inside notch
385 Cutout
390 Interior open paddle area
400 Shaft
410 Axis A
420 Flexible blade
500 Rotating means
510 Motor drive
520 Handle
530 Crank
600 Lid
610 Aperture
620 Adapter
630 Adapter aperture
640 Cup liner
650 Paint sprayer
660 Secondary paddle blade component Referring now to FIG. 1-9, the present invention features a paint agitating system (100) for effectively mixing paint before and during use. In some embodiments, the system (100) comprises a generally cylindrical mixing cup (200) having an open cup top (210), a smooth cup side wall (220), a smooth cup bottom interior surface (230), and a cup interior cavity (240). In some embodiments, the cup comprises a cup height (250) and a cup diameter (260). In some embodiments, the cup diameter (260) tapers. In some embodiments, the cup diameter (260) remains constant.

In some embodiments, the mixing cup (200) is a paint can. In some embodiments, the mixing cup (200) is a cup for a spray gun.

In some embodiments, the system (100) comprises a paddle (300) having a plurality of paddle blades (310). In some embodiments, the paddle blade (310) comprises a paddle first surface (320), an opposing paddle second surface (330), a paddle top edge (340), an opposing paddle bottom edge (350), a paddle outside edge (360), and an opposing paddle inside edge (370). In some embodiments, the paddle blades (310) are connected at the paddle inside edges (370). In some embodiments, the paddle blades (310) comprise one or more cutouts (385) forming an interior open paddle area (390). In some embodiments, the cutouts (385) combine to form a single shaped interior open paddle area (390). In some embodiments, there are a plurality of individual cutouts (385) that do not touch that combine to form the interior open paddle area (390).

In some embodiments, a shaft (400) is located at an intersection of the paddle top edges (340). In some embodiments, the shaft (400) projects out and away from the paddle top edges (340). In some embodiments, the shaft (400) is located on an Axis A (410).

In some embodiments, a flexible blade (420) is located on the paddle (300). In some embodiments, the flexible blade (420) is constructed from a rubber, a silicone rubber, a polymer, or a flexible material. In some embodiments, the flexible blade (420) acts similar to a squeegee.

In some embodiments, the system (100) comprises a rotating means (500) for rotating the paddle (300) via the shaft (400).

In some embodiments, paint is poured into the mixing cup (200). In some embodiments, the paddle (300) is placed in the mixing cup (200). In some embodiments, the rotating means (500) is fastened to the shaft (400). In some embodiments, the paddle (300) is rotated via the rotating means (500) to mix the paint. In some embodiments, paint is scraped off the mixing cup (200) for mixing via the flexible blade (420). In some embodiments, paint is mixed via the paddle blade (310).

In some embodiments, the rotating means (500) is a motor drive (510). In some embodiments, the motor drive (510) attachably connects to the shaft (400) for rotation. In some embodiments, the rotating means (500) is a handle (520). In some embodiments, the handle (520) attachably connects to the shaft (400) for rotation. In some embodiments, the rotating means (500) is a crank (530). In some embodiments, the crank (530) attachably connects to the shaft (400) for rotation.

In some embodiments, the paddle (300) comprises two paddle blades (310). In some embodiments, the paddle (300) comprises three paddle blades (310). In some embodiments, the paddle (300) comprises four or more paddle blades (310). In some embodiments, the paddle (300) is contiguous, regardless of how many paddle blades (310) comprise the paddle (300).

In some embodiments, the flexible blade (420) is located on the paddle top edge (340). In some embodiments, the flexible blade (420) is located on the paddle bottom edge (350). In some embodiments, the flexible blade (420) is located on the paddle outside edge (360). In some embodiments, the flexible blade (420) is located on a combination of edges. In some embodiments the flexible blade (420) is located on a combination of edges and is contiguous.

In some embodiments, the system (100) comprises a lid (600) having an aperture (610) located in a center thereof. In some embodiments, the lid (600) is located on the mixing cup (200). In some embodiments, the lid (600) is planar. In some embodiments, the lid (600) is conical.

In some embodiments, the shaft (400) is rotatably located through the aperture (610). In some embodiments, the system (100) comprises an adapter (620) centrally located in the aperture (610). In some embodiments, the adapter (620) comprises an adapter aperture (630) centrally located therein. In some embodiments, the shaft (400) is rotatably located through the adapter aperture (630).

In some embodiments, a cup liner (640) is slidably located in the mixing cup (200). In some embodiments, the cup liner (640) interfacially contacts the cup side wall (220) and the cup bottom interior surface (230). In some embodiments, the cup liner (640) is disposable and is constructed from a plastic or paper material.

In some embodiments, the system comprises a paint sprayer (650). In some embodiments, the mixing cup (200) is located on the paint sprayer (650). In some embodiments, the system can be agitated on the paint sprayer (650) via a rotating means (500).

In some embodiments, a paddle inside notch (380) is located on the paddle blade (310) on the paddle inside edge (370). In some embodiments, a plurality of paddle inside notches (380) is fluidly connected to form the interior open paddle area (390). In some embodiments, a plurality of paddle inside notches (380) is not fluidly connected, but each comprise an open area together forming the interior open paddle area (390).

In some embodiments, the interior open paddle area (390) comprises a shape of a circle. In some embodiments, the interior open paddle area (390) comprises a shape of an oval. In some embodiments, the interior open paddle area (390) comprises an irregular shape. In some embodiments, the interior open paddle area (390) is formed by one or more paddle inside notches (380) and one or more secondary paddle blade components (660) located on each paddle inside notch (380). In some embodiments, the paddle blades (310) comprise a cutout (385) or a notch on the paddle bottom edge (350). In some embodiments, two opposed paddle blades (310) intersect and comprise a general shape of a horseshoe.

In some embodiments, the present invention features a paint agitating system (100). In some embodiments, the system (100) comprises a generally cylindrical mixing cup (200) having an open cup top (210), a smooth cup side wall (220), a smooth cup bottom interior surface (230), and a cup interior cavity (240). In some embodiments, the mixing cup (200) comprises a cup height (250) and a cup diameter (260). In some embodiments, the mixing cup (200) is a paint can. In some embodiments the mixing cup (200) tapers to a smaller diameter as the cup side wall (220) approaches the bottom interior surface (230). In some embodiments the mixing cup (200) does not taper to a smaller diameter as the cup side wall (220) approaches the bottom interior surface (230).

In some embodiments, the system (100) comprises a paddle (300) having a plurality of paddle blades (310). In some embodiments, the paddle blade (310) comprises a paddle first surface (320), a paddle second surface (330), a paddle top edge (340), a paddle bottom edge (350), a paddle outside edge (360), a paddle inside edge (370), and a paddle inside notch (380). In some embodiments, the paddle blades (310) are connected at the paddle inside edges (370). In some embodiments, the paddle inside notches (380) are fluidly connected to form an interior open paddle area (390). In some embodiments, the paddle blades (310) are connected at the paddle inside edges (370) via unitary construction.

In some embodiments, a shaft (400) is located on the paddle top edge (340). In some embodiments, the shaft (400) projects out and away from the paddle top edge (340) at the intersection of the paddle top edge (340) and the paddle inside edge (370). In some embodiments, the shaft (400) is located on an Axis A (410). In some embodiments, Axis A lies on the paddle inside edge (370). In some embodiments, a flexible blade (420) is located on the paddle outside edge (360). In some embodiments, the flexible blade (420) is adapted to scrape the cup side wall (220).

In some embodiments, the system (100) comprises a rotating means (500) for rotating the paddle (300) via the shaft (400).

In some embodiments, for use, paint is poured into the mixing cup (200). In some embodiments, the paddle (300) is inserted into the mixing cup (200). In some embodiments, a rotating means (500) is fastened on and coupled to the shaft (400). In some embodiments, the paddle (300) is rotated via the rotating means (500) to mix the paint. In some embodiments, paint is scraped off the cup side wall (220) via the flexible blade (420). In some embodiments, paint is mixed via the paddle blade (310).

In some embodiments, the rotating means (500) is a motor drive (510). In some embodiments, the motor drive (510) attachably connects to the shaft (400) for rotation. In some embodiments, the motor drive (510) is an electric screwdriver or a drill. In some embodiments, the rotating means (500) is a handle (520). In some embodiments, the handle (520) attachably connects to the shaft (400) for rotation. In some embodiments, the rotating means (500) is a crank (530). In some embodiments, the crank (530) attachably connects to the shaft (400) for rotation.

In some embodiments, the paddle (300) comprises two paddle blades (310). In some embodiments, the paddle (300) comprises three paddle blades (310). In some embodiments, the paddle (300) comprises four paddle blades (310). In some embodiments, the paddle (300) comprises more than four paddle blades (310).

In some embodiments, a flexible blade (420) is located on the paddle top edge (340). In some embodiments, a flexible blade (420) is located on the paddle bottom edge (350). In some embodiments, the system (100) comprises a lid (600) having an aperture (610) located in a center thereof. In some embodiments, for use, the lid (600) is located on the mixing cup (200).

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A paint agitating system (100), wherein said system (100) comprises:

(a) a generally cylindrical mixing cup (200) having an open cup top (210), a smooth cup side wall (220), a smooth cup bottom interior surface (230), and a cup interior cavity (240), wherein the cup comprises a cup height (250) and a cup diameter (260);

(b) a paddle (300) having a plurality of paddle blades (310), wherein the paddle blade (310) comprises a paddle first side (321), a paddle second side (331), a paddle top edge (340), a paddle bottom edge (350), a paddle outside edge (360), and a paddle inside edge (370), wherein the paddle first side (321) and the paddle second side (331) are respectively disposed proximal to opposite sides of the smooth cup side wall (220), wherein the paddle blades (310) are connected at the paddle inside edge (370), wherein the paddle blades (310) comprise single interior open paddle area (390), the interior open paddle area (390) being entirely devoid of obstruction, thus being a single unobstructed central interior open paddle area, wherein a shaft (400) is disposed at an intersection of the paddle top edge (340), wherein the shaft (400) projects out and away from the paddle top edges (340), wherein the shaft (400) is disposed along a portion of an Axis A (410), wherein the shaft (400) attaches to the paddle top edge (340), the shaft (400) being operationally connected to the paddle bottom edge (350) only via the paddle first side (321) and the paddle second side (331), the shaft terminating within the paddle top edge (340), wherein the single unobstructed central interior open paddle area partly lies on Axis A (410), wherein a flexible blade (420) is disposed on the paddle (300); and (c) a rotating means (500) for rotating the paddle (300) via the shaft (400);

wherein paint is poured into the mixing cup (200), wherein the paddle (300) is disposed in the mixing cup (200), wherein the rotating means (500) is disposed on the shaft (400), wherein the paddle (300) is rotated via the rotating means (500) to mix the paint, wherein paint is scraped off the mixing cup (200) for mixing via the flexible blade (420), wherein paint is mixed via the paddle blade (310).

2. A paint agitating paddle (300), wherein the paint agitating paddle (300) comprises a plurality of paddle blades (310), wherein each paddle blade (310) comprises a paddle first side (321), a paddle second side (331), a paddle top edge (340), a paddle bottom edge (350), a paddle outside edge (360), and a paddle inside edge (370), wherein the paddle blades (310) are connected at the paddle inside edge (370), wherein the paddle blades (310) comprise a single interior open paddle area (390), the interior open paddle area (390) being entirely devoid of obstruction, thus being a single unobstructed central interior open paddle area, wherein a shaft (400) is disposed at an intersection of the paddle top edge (340), wherein the shaft (400) projects out and away from the paddle top edges (340), wherein the shaft (400) is disposed along a portion of an Axis A (410), wherein the shaft (400) attaches to the paddle top edge (340), the shaft (400) being operationally connected to the paddle bottom edge (350) only via the paddle first side (321) and the paddle second side (331), the shaft terminating within the paddle top edge (340), wherein the single unobstructed central interior open paddle area partly lies on Axis A (410), wherein a flexible blade (420) is disposed on the paddle (300).

3. The system (100) of claim 1, wherein the rotating means (500) is a motor drive (510), wherein the motor drive (510) attachably connects to the shaft (400) for rotation.

4. The system (100) of claim 1, wherein the rotating means (500) is a crank (530), wherein the crank (530) attachably connects to the shaft (400) for rotation.

5. The system (100) of claim 1, wherein the flexible blade (420) is disposed on the paddle top edge (340).

6. The system (100) of claim 1, wherein the flexible blade (420) is disposed on the paddle bottom edge (350).

7. The system of claim 1, wherein the flexible blade (420) is disposed on the paddle outside edge (360).

8. The system (100) of claim 1, wherein the system (100) comprises a lid (600) having an aperture (610) disposed in a center thereof, wherein the lid (600) is disposed on the mixing cup (200), wherein the shaft (400) is rotatably disposed through the aperture (610).

9. The system (100) of claim 8, wherein the system (100) comprises an adapter (620) centrally disposed in the aperture (610), wherein the adapter (620) comprises an adapter aperture (630) centrally disposed therein, wherein the shaft (400) is rotatably disposed through the adapter aperture (630).

10. The system (100) of claim 1, wherein a cup liner (640) is slidably disposed in the mixing cup (200), wherein the cup liner (640) interfacially contacts the cup side wall (220) and the cup bottom interior surface (230).

11. The system (100) of claim 1, wherein the system comprises a paint sprayer (650), wherein the mixing cup (200) is disposed on the paint sprayer (650).

12. The system (100) of claim 1, wherein the interior open paddle area (390) comprises a shape of a circle.

13. The system (100) of claim 1, wherein the interior open paddle area (390) comprises a shape of an oval.

14. The system (100) of claim 1, wherein the interior open paddle area (390) comprises an irregular shape.

15. A paint agitating system (100), wherein said system (100) consists of:

(a) a generally cylindrical mixing cup (200) consisting of an open cup top (210), a smooth cup side wall (220), a smooth cup bottom interior surface (230), and a cup interior cavity (240), wherein the cup consists of a cup height (250) and a cup diameter (260);

(b) a paddle (300) consisting of a plurality of paddle blades (310), wherein each paddle blade (310) consisting of a paddle first side (321), a paddle second side (331), a paddle top edge (340), a paddle bottom edge (350), a paddle outside edge (360), and a paddle inside edge (370), wherein the paddle first side (321) and the paddle second side (331) are respectively disposed proximal to opposite sides of the smooth cup side wall (220), wherein the paddle blades (310) are connected at the paddle inside edges (370), wherein the paddle blades (310) consisting of a single interior open paddle area (390), the interior open paddle area (390) being entirely devoid of obstruction, thus being a single unobstructed central interior open paddle area, wherein a shaft (400) is disposed at an intersection of the paddle top edges (340), wherein the shaft (400) projects out and away from the paddle top edges (340), wherein the shaft (400) is disposed along a portion of an Axis A (410), wherein the shaft (400) attaches to the paddle top edge (340), the shaft (400) being operationally connected to the paddle bottom edge (350) only via the paddle first side (321) and the paddle second side (331), the shaft terminating within the paddle top edge (340), wherein the single unobstructed central interior open paddle area partly lies on Axis A (410), wherein a flexible blade (420) is disposed on the paddle (300); and (c) a rotating means (500) for rotating the paddle (300) via the shaft (400);

wherein paint is poured into the mixing cup (200), wherein the paddle (300) is disposed in the mixing cup (200), wherein the rotating means (500) is disposed on the shaft (400), wherein the paddle (300) is rotated via the rotating means (500) to mix the paint, wherein paint is scraped off the mixing cup (200) for mixing via the flexible blade (420), wherein paint is mixed via the paddle blade (310).

* * * * *